US012317988B2

(12) United States Patent
Wang

(10) Patent No.: US 12,317,988 B2
(45) Date of Patent: Jun. 3, 2025

(54) INSULATION BAG

(71) Applicant: XIAMEN GODZILLA INDUSTRY & TRADE CO., LTD., Xiamen (CN)

(72) Inventor: Xiao Qing Wang, Xiamen (CN)

(73) Assignee: XIAMEN GODZILLA INDUSTRY & TRADE CO., LTD., Xiamen (CN)

( * ) Notice: Subject to any disclaimer, the term of this patent is extended or adjusted under 35 U.S.C. 154(b) by 326 days.

(21) Appl. No.: 17/964,029

(22) Filed: Oct. 11, 2022

(65) Prior Publication Data

US 2024/0016282 A1 Jan. 18, 2024

(30) Foreign Application Priority Data

Jul. 14, 2022 (CN) ..... 202221808369.1
Sep. 21, 2022 (CN) ..... 202222509888.4

(51) Int. Cl.

| | |
|---|---|
| ***A45F 5/04*** | (2006.01) |
| ***A45C 13/00*** | (2006.01) |
| ***A45C 13/10*** | (2006.01) |
| ***A45F 3/02*** | (2006.01) |
| ***A45F 3/04*** | (2006.01) |
| *A45F 3/00* | (2006.01) |

(52) U.S. Cl.

CPC ..... *A45F 3/047* (2013.01); *A45C 13/008* (2013.01); *A45C 13/1069* (2013.01); *A45F 3/02* (2013.01); *A45F 2003/001* (2013.01)

(58) Field of Classification Search

CPC ..... A45C 11/20; A45C 11/22; A45C 13/008; A45C 13/10; A45C 13/1069; A45F 2003/001; A45F 3/02; A45F 3/047; B65D 2313/04; B65D 81/38; F25D 3/08

USPC ..... 224/153

See application file for complete search history.

(56) References Cited

U.S. PATENT DOCUMENTS 11,229,268 B2 * 1/2022 Munie ..... B65D 81/38

FOREIGN PATENT DOCUMENTS

| | | | | |
|---|---|---|---|---|
| CN | 106986106 A | | 7/2017 | |
| CN | 113277207 A | | 8/2021 | |
| CN | 215603773 U | | 1/2022 | |
| JP | 2006069583 A | * | 3/2006 | |
| KR | 200485945 Y1 | * | 3/2018 | |
| WO | WO-2011145088 A2 | * | 11/2011 | ..... A44B 18/00 |

OTHER PUBLICATIONS

KR-200485945-Y1 Translation, 안기성, Mar. 15, 2018 (Year: 2018).*
JP-2006069583-A Translation, Miyajima K, Mar. 16, 2006 (Year: 2006).*

* cited by examiner

*Primary Examiner* — Nathan J Newhouse
*Assistant Examiner* — Matthew T Theis

(57) ABSTRACT

An insulation bag includes a main body and a lid connectable to the main body. An upper part of the main body forms an opening, and the lid is attached to the opening to seal the insulation bag. A first connection element and a second connection element are respectively arranged on the main body and the lid, and the first connection element and second connection element are connected to each other by magnetic attraction or mechanical engagement which can get rid of the use of zipper, thereby simplifying the operation of opening and closing the insulation bag while improving the sealing performance and stability of connection.

18 Claims, 14 Drawing Sheets

INSULATION BAG

CROSS-REFERENCE TO RELATED APPLICATIONS

This application is based upon and claims priority to Chinese Patent Application No. 202221808369.1, filed on Jul. 14, 2022, and Chinese Patent Application No. 202222509888.4, filed on Sep. 21, 2022, the entire content of which is incorporated herein by reference.

TECHNICAL FIELD

The present disclosure relates to the technical field of bags, in particular to an insulation bag.

BACKGROUND

Nowadays, most of people usually choose to bring food themselves for picnics or in daily life. In order to maintain food quality, insulation bag is generally used to carry foods while keeping them fresh. Insulation bags are a kind of bags that are commonly used to hold various foods and maintain the temperature and freshness of the food. Insulation bags are widely used in daily life, especially in takeaway and family picnic etc.

The insulation bag generally has a main body and a lid. The main body is internally provided with an insulation layer. After food is put inside the main body, the main body maybe zipped up with the lid for sealing. Chinese Patent Publication No. CN113277207A discloses an insulation bag which includes a main body mainly consisting of an outer layer and an inner layer. The upper end of the main body is provided with a lid, and the lid has a built-in foam layer. The inner layer is made of ABS resin integrated with polyester thermal insulation foam. The insulation bag also uses zipper to close the main body and the lid, and fasteners and strips may be used to further secure the lid. However, this type of insulation bags have the following drawbacks. First, the zipper is visible from the outside which affects the overall appearance of the bag. Second, user needs to zip up or unzip the zipper to close or open the lid, which is inconvenient to operate. Third, the zipper has poor sealing effect which may cause heat exchange between inside and outside of the bag and liquid leakage from the zipper, thereby reducing the insulation effect.

Chinese Patent Publication No. CN106986106A discloses an insulation bag including a main body and a lid connected to the main body through a connector. The lid can be opened by the connector, and the connector is a waterproof zipper which includes an upper zipper tape, a lower zipper tape, and a slider and pull configured to bind or separate the upper and lower zipper tapes. The upper zipper tape is fixed at a lower edge of the lid, and the lower zipper tape is fixed at an upper edge of the main body. This type of insulation bags also have the drawbacks of complex closing or opening operation, poor sealing performance, and poor insulation effect. Further, since the zipper is flexible, the connection between the main body the bag and the lid is deformable or may be damaged under collision by outside force, weakening the structural strength of the bag.

SUMMARY

The present disclosure aims at overcoming the drawbacks of the prior art, and provides a novel insulation bag which has good sealing and insulation performance and is less likely to leak and convenient for use.

According to an aspect of the present disclosure, an insulation bag is provided which includes:

a main body, wherein the main body has an opening at an upper end and the opening is provided with an upper edge loop, the upper edge loop includes a convex part extending along the upper edge loop, a plurality of first magnetic attractable elements are evenly arranged on the convex part; and a lid, wherein the lid is configured to seal the opening at the upper end of the main body, a lower edge loop is fixed at a bottom of the lid, the lower edge loop includes a concave part corresponding to the convex part, the concave part is internally provided with a plurality of second magnetic attractable elements corresponding to the first magnetic attractable elements, when the lid is covered on the upper end of the main body, the concave part is engaged with the convex part, and the first magnetic attractable elements and the second magnetic attractable elements attach to each other through magnetic attraction.

Furthermore, a side of the lid is rotatably connected to a back side of the main body, the lid is provided with a fastener, a front side of the main body is provided with a engagement groove matching with the fastener, when the lid is closed with the main body to seal the insulation bag, the fastener is engaged with the engagement groove.

Furthermore, the upper edge loop further includes first shoulder parts located at two sides of the convex part, and the lower edge loop further comprises second shoulder parts located at two sides of the concave part.

Furthermore, the first magnetic attractable elements are embedded in the convex part, and the second magnetic attractable elements are embedded in the concave part.

Furthermore, the main body is provided with an adjustable shoulder strap and a hand strap.

Furthermore, the lower edge loop is fixed on the bottom of the lid by laser punching.

According to another aspect of the present disclosure, an insulation bag is provided which includes:

a main body, wherein the main body is provided with an opening;

a lid, wherein the lid is configured to close the opening; and a magnetic attractable assembly for tightly attaching the lid on the opening, wherein the magnetic attractable assembly includes a first magnetic attractable element hidden in the opening or the lid and a second magnetic attractable element corresponding to the first magnetic attractable element arranged on the lid or the opening;

wherein the first magnetic attractable element includes a magnetic particle positioning element, a plurality of magnetic particle holes provided on the magnetic particle positioning element and arranged at intervals along the opening, and magnet particles arranged in the magnetic particle holes; the second magnetic attractable element includes a magnetic element configured to closely attract the lid to the opening under the attraction of the magnet particles, or the second magnetic attractable element also includes a magnetic particle positioning element, a plurality of magnetic particle holes provided on the magnetic particle positioning element and arranged at intervals along the opening, and magnet particles arranged in the magnetic particle holes.

Furthermore, the first magnetic attractable element includes a magnet hiding loop fitted with and fixed on the opening to cover and hide the magnetic particle positioning element, a central part of the magnet hiding loop protrudes upward to form a connecting groove of a loop shape, and the magnetic particle positioning element has the same shape as the connecting groove and is embedded and fixed in the connecting groove.

Furthermore, the first magnetic attractable element includes a first magnetizable piece, the first magnetizable piece has the same shape as the magnetic particle positioning element and is attached on a top surface of the magnetic particle positioning element, the magnetizable piece is embedded between the magnetic particle positioning element and an inner top surface of the connecting groove.

Furthermore, the magnetic element is a the magnetic plate connected to the lid in a hidden manner, the magnetic plate and the first magnetic attractable element attract each other by magnetic force, and the first magnetizable piece and the magnetic plate are both made of ferromagnetic material. Furthermore, the first magnetic attractable element includes a magnet hiding plate fitted with and attached on a bottom surface of the lid, the magnet hiding plate is configured to cover and hide the magnetic particle positioning element in the bottom surface of the lid, a connecting part is raised upward from an edge of the magnet hiding plate to form a recess, the magnetic particle positioning element has a shape fitted with a shape of the lid, and the magnetic particle positioning element is arranged in the recess formed by the connecting part and the magnet hiding plate.

Furthermore, the first magnetic attractable element includes a first magnetizable piece, the first magnetizable piece has a shape the same as the magnetic particle positioning element and is attached with a bottom surface of the magnetic particle positioning element, the first magnetizable piece is embedded in the recess and located between the magnetic particle positioning element and the magnet hiding plate.

Furthermore, the magnetic element is a magnetic loop attached to a top surface of the opening in a hidden manner, the magnetic loop and the first magnetic attractable element attract each other by magnetic force, and the first magnetizable piece and the magnetic loop are both made of ferromagnetic material.

Furthermore, a strap is fixed on the main body, a first end of the strap is fixed on a side of the main body, a second end of the strap goes over the lid to be attached on another side of the main body to provide an auxiliary fastening for the lid.

Furthermore, the second magnetic attractable element includes the magnetic particle positioning element, the plurality of magnetic particle holes provided on the magnetic particle positioning element and the magnet particles arranged in the magnetic particle holes, the first magnetic attractable element and the second magnetic attractable element are both provided with a magnetizable piece having a shape fitted with a shape of the magnetic particle positioning element, and the magnetizable piece is made of ferromagnetic material.

According to yet another aspect of the present disclosure, an insulation bag is provided which includes:

a main body, wherein an upper part of the main body is provided with an opening, and the main body is provided with a plurality of lower fasteners at a side of the opening;

a lid matched with the opening, wherein the lid is provided with upper fasteners configured to be engaged with the lower fasteners; and a sealing assembly, wherein the sealing assembly includes a sealing strip arranged along the opening and a lower edge element arranged at a lower side of the lid, a bottom side of the lower edge element is provided with a first concave part, and a top side of the sealing strip is provided with a first convex part connectable to the first concave part in a squeezed manner, wherein the first convex part has a height greater than a depth of the first concave part, and the first convex part has a width smaller than a width of the first concave part.

Furthermore, the height of the first convex part is 2 mm-4 mm greater than the depth of the first concave part, and the width of the first convex part is 0.5 mm-1.5 mm smaller than the width of the first concave part.

Furthermore, the sealing assembly further includes an upper edge element arranged on the opening, and a second convex part is provided and extends around the top of the upper edge element, the sealing strip is mounted on the second convex part, a second concave part corresponding to the second convex part is arranged at the bottom of the lower edge element, the first concave part is located inside the second concave part, when the second convex part is inserted into the second concave part, the first convex part is squeezed in the first concave part.

Furthermore, the sealing strip further comprises shoulders integrally provided on both sides of the first convex part, and sidewalls of the shoulders are aligned with sidewalls of the second convex part, a depth of the second concave part is equal to a sum of the heights of the shoulders and the second convex part.

Furthermore, a cavity is formed inside the first convex part, a top part and side parts of the first convex part are connected by an arc-shaped surface.

The present disclosure has the following advantages.

According to one embodiment of the present disclosure, a main body of the insulation bag is provided with an upper edge loop having a convex part of a loop shape, and a bottom surface of a lid of the insulation bag is provided with a lower edge loop having a concave part corresponding to the the convex part. When the lid is covered on the main body, the convex part is engaged with the concave part, so that a closed space is formed inside the insulation bag. Such sealing structure works well in blocking internal or external fluid (such as liquid and gas). The engagement of the convex part and the concave part at the joint of the body and the lid form a close attachment being resistant to fluid from inside or outside, which prevents liquid leakage while ensuring the stability of the sealing structure.

Further, the convex part is provided with a plurality of first magnetic attractable elements and the concave part is provided with a plurality of second magnetic attractable elements corresponding to the first magnetic attractable elements. When the concave part is engaged with the convex part, the first magnetic attractable elements and the second magnetic attractable elements attract each other by magnetic force, such that the connection between the concave part and the convex part is firmer and the sealing effect is improved. In practice, one only needs to directly cover the lid on the main body, and the lid and the main body are closed and fixed together through magnetic force. Unexpected opening of the bag during use can be avoided, and since the magnetic attractable elements are uniformly arranged, the production cost can be reduced while ensuring that the magnetic attraction force is strong enough but not excessive to avoid difficulty in opening and affecting the user experience.

According to yet another embodiment of the present disclosure, the lid and the main body of the insulation bag may also be provided with fasteners to secure the connection of the lid and the main body and avoid unexpected opening of the lid during movement, thereby improving the stability of the connection mechanism.

According to yet another embodiment of the present disclosure, one of the opening of the main body of the insulation bag and the lid of the insulation bag is provided with the first magnetic attractable element, and the other one is provided with the second magnetic attractable element, so as to connect the main body and the lid of the insulation bag through magnetic attraction force. By doing so, the opening and closing of the bag can be realized by simply lifting or covering the lid, which is convenient and can get rid of the troublesome operations of zipping up or unzipping. Additionally, the first magnetic attractable element and the second magnetic attractable element are connected to the main body or the lid in a hidden manner, so the position where the main body and lid connect is smooth, tidy, and aesthetics. Further, the two magnetic attractable elements produce magnetic force over the entire connection surfaces, which improves the connection strength and stability of the main body and the lid.

According to yet another embodiment of the present disclosure, the magnetic particle positioning element is internally provided with a plurality of magnetic particle holes where magnet particles are embedded or mounted. The magnetic particle holes can limit and fix the magnet particles and facilitate the installation of the magnet particles. The magnet hiding loop or magnetic plate can hide the magnetic particle positioning element and the corresponding magnetizable piece in the opening or the lid of the insulation bag, so that the opening and the lid of the insulation bag are smoother, tidier, and aesthetic. The corresponding magnetizable piece is made of ferromagnetic material which can be magnetized by the magnet particles on the magnetic particle positioning element and form an integral magnetic plate or magnetic loop. As a such, the magnetic connection strength between the first magnetic attractable element and the second magnetic attractable element is improved.

According to yet another embodiment of the present disclosure, magnetic attractable elements are correspondingly arranged on the opening and the lid of the insulation bag, the pair of magnetic attractable elements work jointly to connect the main body and lid of the insulation bag. One of the pair of magnetic attractable elements may be magnetic and the other one may be non-magnetic, or both of the two magnetic attractable elements may be magnetic. With only one magnetic attractable element being magnetic, the use of magnets can be reduced, and the overall production cost and the weight of the insulation bag can be lowered. With both of the magnetic attractable elements being magnetic, better magnetic attraction effect can be achieved and the stability of the connection between the main body and the lid can be improved.

According to yet another embodiment of the present disclosure, the configuration of the insulation pad can utilize the shock-absorbing and heat-insulating property of the EVA material to reduce heat dissipation from the opening position and improve the insulation performance of the insulation bag. Additionally, the EVA material is perfectly resistant to water and moisture, which can keep the insulation bag dry and prevent leakage of liquid in the insulation bag when being overturned. The configuration of the strap provides an auxiliary fastening of the main body and the lid, thus further improving the stability of the connection.

According to the present disclosure, the main body and the lid are connected by means of magnetic connection. By hiding the magnetic attractable elements in the main body and the lid, the appearance of the joint position is improved. One only needs to lift up or cover the lid to close or open the insulation bag, the lid and the main body can connect to each other automatically, thus the operation is convenient and fast. The magnetic attractable elements can not only enhance the tightness of the connection between the main body and the lid, but also has insulation effect which can reduce the speed of heat dissipation at the position where the lid and the main body connect, thereby improving the overall insulation effect of the insulation bag.

According to yet another aspect of the present disclosure, the main body and the lid are sealed and fixed by the combination of fasteners and sealing assembly. In practice, the lid is covered on the main body to enable the sealing strip to be pressed and arranged in the concave part of the lower edge loop, and the upper and lower fasteners are locked together to fix the lid. The pressure generated when the upper and lower fasteners are locked together allows the sealing strip to be tightly filled into the concave part, so the main body and the lid are attached together to achieve sealing and fixing. The use of the insulation bag in this embodiment is simple as one can open the insulation bag by simply releasing the fasteners. Compared with the prior art which uses zipper to open or close the bag, the sealing strip has better sealing performance, thus the insulation effect is improved. In this embodiment, the sealing strip is provided with a convex part in the middle, and a corresponding concave part is provided on the lower edge loop of the lid. The engagement of the convex part and the concave part form a closed space inside the bag. Compared with the engagement of flat planes or steps, this sealing structure is better resistant to fluid from the inside or outside. The convex-concave joint forms a sealing structure with two vertical walls attached with each other, which prevents leakage of liquid or gas and improves the stability of the sealing structure. In this embodiment, the height of the first convex part of the sealing strip is greater than the depth of the first concave part of the lower edge loop, and the width of the first convex part is smaller than the width of the first concave part. When the lid is covered on the main body, the first convex part is compressed in the first concave part, and the top part of the first convex part is under pressure to make two sidewalls extending outwards, so that the sidewall are pressed by and closely attached to the sidewalls of the first concave part. In the above sealing structure, top part and sidewalls are both pressed to fit with the concave part, which can improve the sealing performance.

According to yet another embodiment of the present disclosure, an upper edge loop and a lower edge loop which are both made of rigid material are provided, so that the opening is less likely to get deformed when the lid is closed with the main body, thereby improving the structural strength of the sealing position and avoiding failure of the sealing structure due to deformation of the opening under impact of external force.

BEIRF DESCRIPTION OF THE DRAWINGS

In order to clarify the technical solutions of the embodiments of the present disclosure, the accompanying drawings to be used in the illustration of the embodiments will be briefly introduced below. It should be understood that the drawings merely show some of the embodiments of the present disclosure and should not be regarded as restrictions to the scope. For those skilled in the art, other related drawings can also be derived from these drawings without creative efforts.

DETAILED DESCRIPTION OF THE EMBODIMENTS

Figure 1:
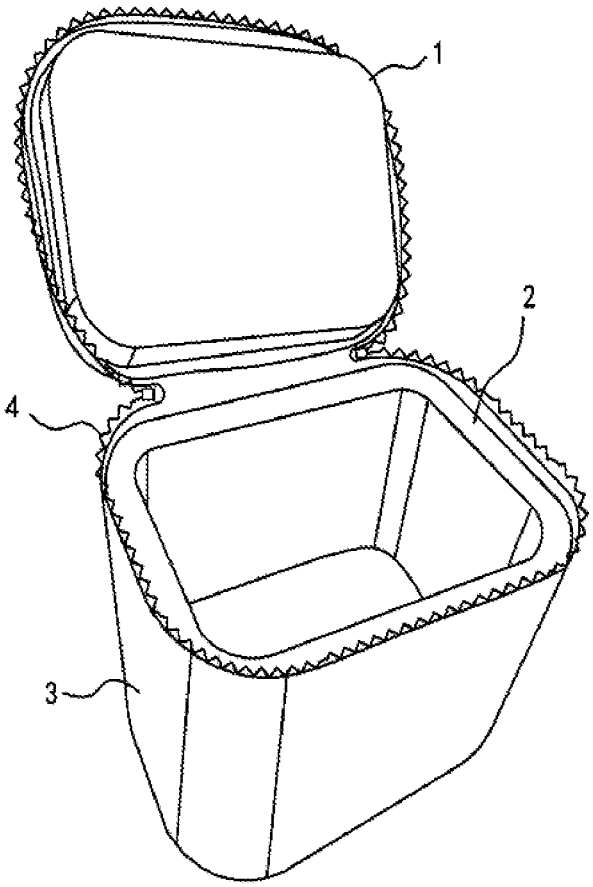
FIG. 1 (Prior Art)
FIG. 1 is a structural diagram of an insulation bag in the prior art.
Figure 2:
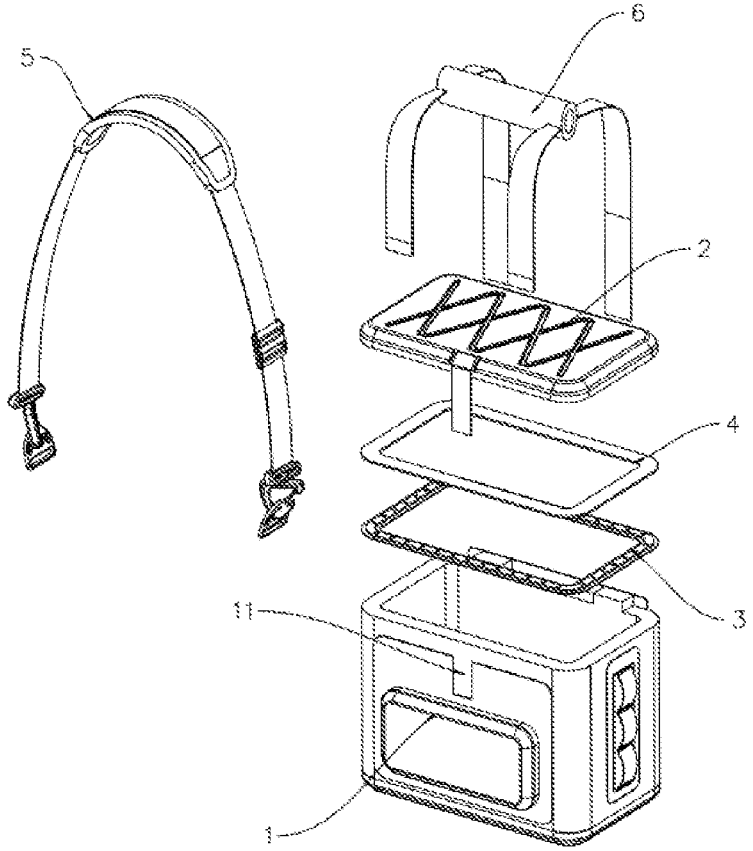
FIG. 2 is an exploded view of the overall structure of the first embodiment of the present disclosure.
Figure 3:
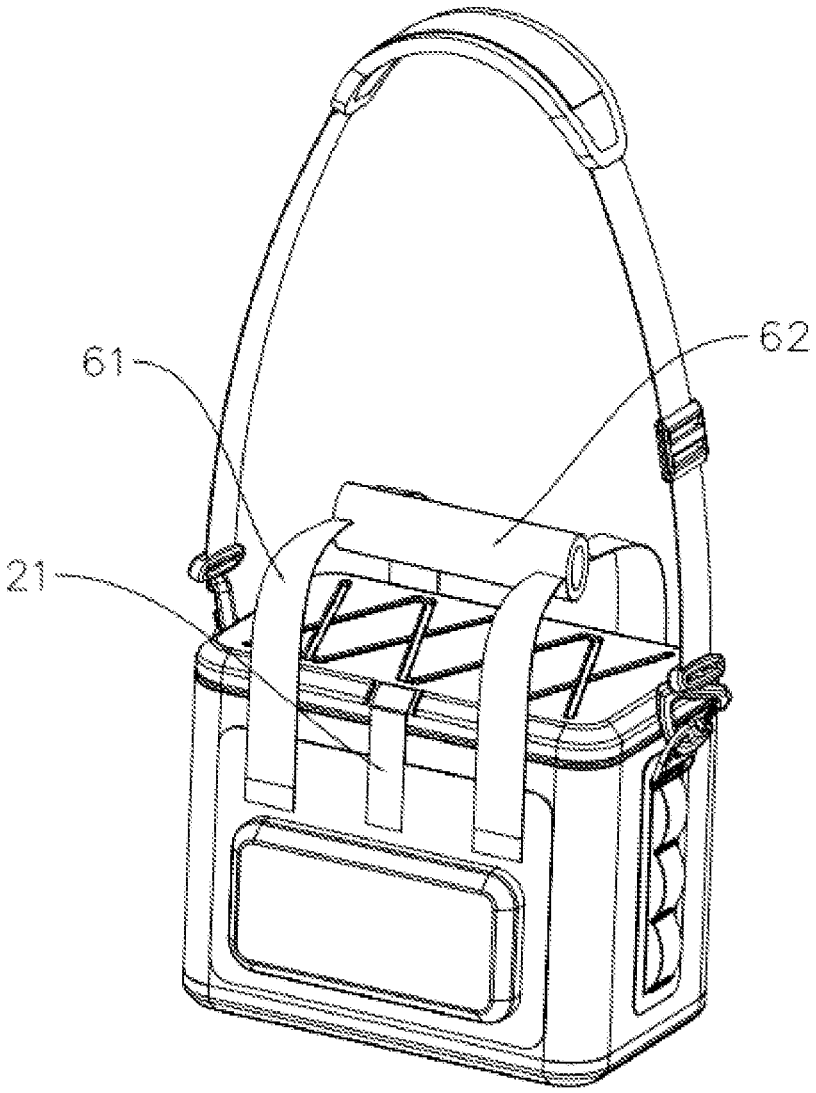
FIG. 3 is a schematic diagram of the overall structure of the first embodiment of the present disclosure.
Figure 4:
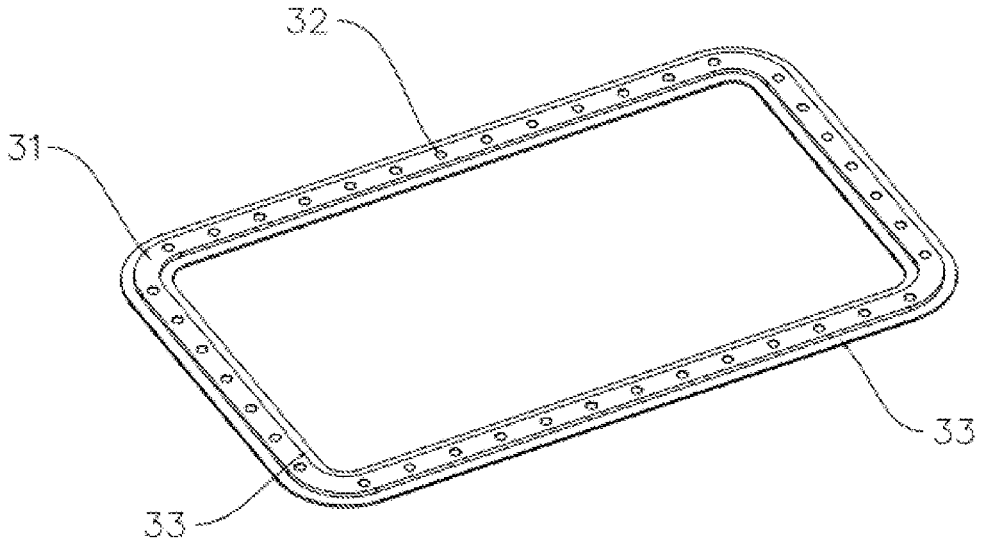
FIG. 4 is a structural schematic diagram of an upper edge loop of the first embodiment of the present disclosure.
Figure 5:
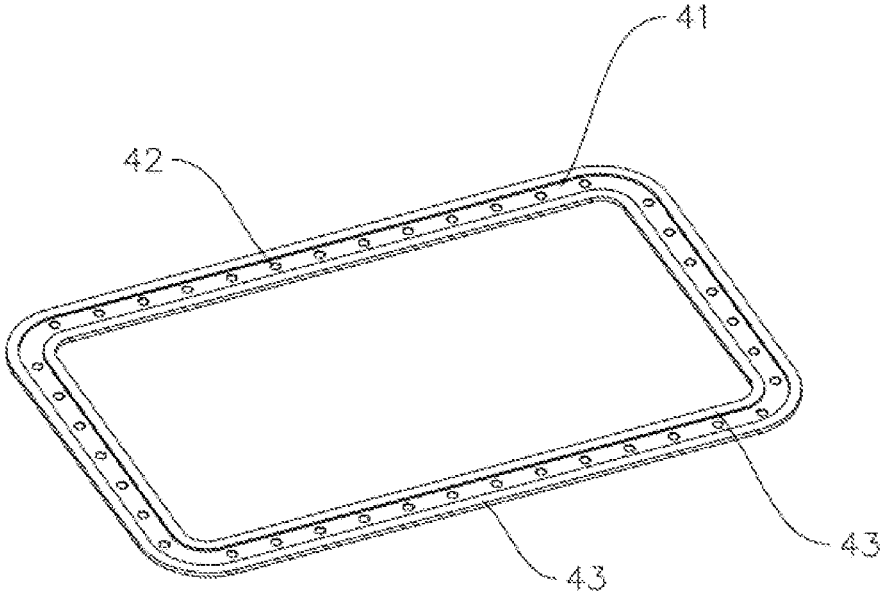
FIG. 5 is a structural schematic diagram of a lower edge loop of the first embodiment of the present disclosure.

In order to clarify the objectives, technical solutions, and advantages of the embodiments of the present disclosure, the technical solutions of the embodiments of the present disclosure will be clearly and completely described below with reference to the accompanying drawings. Obviously, the described embodiments merely include some of the embodiments of the present disclosure rather than all. Based on the embodiments of the present disclosure, all other embodiments derived by those of ordinary skill in the art without creative effort fall within the scope of protection of the present disclosure. Accordingly, the following detailed description of the embodiments of the present disclosure illustrated in the accompanying drawings is not intended to limit the scope of the invention as claimed, but is merely intended to represent selected embodiments of the present disclosure.

In the description of the present disclosure, the terms "first" and "second" are merely used for descriptive purpose, and cannot be understood as indicating or implying relative importance or implying the number of indicated technical features. Thus, a feature defined by "first" or "second" may expressly or implicitly include one or more of that feature.

It should be noted that when a first element is defined as being fixed on a second element, the first element may be directly located on the second element or an intermediate element may be configured between them. When a first element is defined as being connected or coupled to a second element, the first element may be directly connected to the second element, or there may be an intermediate element. Also, the terms "vertical", "horizontal", "left", "right" or other similar terms are used for descriptive purpose rather than restricting the scope of the implementations.

Except otherwise defined, all terminologies used in the present disclosure share the same meaning with those was commonly understood by those skilled in the art. The terminologies used in the present disclosure are intended to describe the embodiments rather than restrict the scope of the present disclosure.

Embodiment 1

FIGS. 2-5 show an insulation bag includes a main body 1 and a lid 2. The main body 1 has an opening at an upper end and forms a chamber for accommodating objects. The lid 2 is used to seal the chamber of the main body 1. An upper edge loop 3 is fixed along an edge of the opening at the upper end of the main body 1. The upper edge loop 3 includes a convex part 31 extending along the upper edge loop and a first shoulder part 33 located at both sides of the convex part 31. A plurality of first magnetic attractable elements 32 are evenly arranged on the convex part 31, and an outer wall of the upper edge loop 3 is aligned with an outer wall of the main body 1. A lower edge loop 4 is fixed along an outer edge of a bottom surface of the lid 2. The lower edge loop 4 includes a concave part 41 corresponding to the convex part 31. A second shoulder part 43 is located at both sides of the concave part 41. The concave part 41 is internally provided with a plurality of second magnetic attractable elements 42 corresponding to the first magnetic attractable elements 32, and an outer wall of the lower edge loop 4 is aligned with an outer wall of the lid 2. When the lid 2 is covered on the upper end of the main body 1, the concave part 41 is fully engaged with the convex part 31 to form a sealing structure between the upper edge loop 3 and the lower edge loop 4. Additionally, two sides of the convex part 31 and the concave part 41 are respectively provided with the first shoulder part 33 and second shoulder part 43 to establish a concave-convex fit which plays the role of sealing structure with full surface contact at the joint and two closed vertical surfaces formed at an inner side and an outer side. Such that, fluid or liquid can be blocked by the two closed vertical surfaces and kept from leaking, thereby improving the sealing effect. Meanwhile, the engagement between the concave part 41 and the convex part 31 effectively improves the stability and reliability of the connection between the main body 1 and the lid 2 and prevents unexpected detachment. The first magnetic attractable elements 32 and the second magnetic attractable elements 42 are connected by magnetic attraction force, so as to firmly connect the concave part 41 with the convex part 31 and fix the lid 2 on the main body 1. Thus, the fixation and sealing of the lid and the main body are realized.

According to the present embodiment, the first magnetic attractable elements 32 and the second magnetic attractable elements 42 are both evenly spaced and respectively arranged on the upper edge loop 3 and the lower edge loop 4. By doing so, sufficient magnetic attraction force is provided while reducing the material cost and avoiding excessive magnetic force that may be produced due to large contact area of the magnetic attractable elements and cause difficulties in lifting the lid 2.

According to the present embodiment, a side of the lid 2 is rotatably connected to the back side of the main body 1, and the lid 2 is provided with a fastener 21. The front side of the main body 1 is provided with an engagement groove 11 corresponding to the fastener 21. When the lid 2 is closed with the main body 1 to seal the insulation bag, the fastener 21 is engaged with the engagement groove 11, so as to further secure the connection between the main body 1 and the lid 2. Meanwhile, since the engagement groove 11 and the fastener 21 have fixed locations, only when the upper edge loop 3 and the lower edge loop 4 are fully attached to each other, the fastener 21 is able to be engaged with the engagement groove 11.

According to the present embodiment, the first magnetic attractable elements 32 are embedded in the convex part 31, the second magnetic attractable elements 42 are embedded in the concave part 41, the upper surface of the first magnetic attractable elements 32 is aligned with the upper surface of the convex part 31, and the upper surface of the second magnetic attractable elements 42 is aligned with the lower surface of the concave part 41. When the lid 2 is closed with the main body 1, the first magnetic attractable elements 32 are attached with the second magnetic attractable elements 42.

According to the present embodiment, the main body 1 is provided with an adjustable shoulder strap 5 and a hand strap 6. The length of the shoulder strap 5 is adjustable to satisfy users of different heights. The shoulder strap 5 provides the user different selections to use the insulation bag. Specifically, the hand strap 6 includes lifting parts 61 located at two sides of the main body 1 and a fixation part 62. In practice, the lifting parts 61 at two sides are put together and fixed by the fixation part 62 for holding and lifting by the user.

According to the present embodiment, the lower edge loop 4 may be fixed on the bottom of the lid 2 by laser punching.

Embodiment 2

Figure 6:
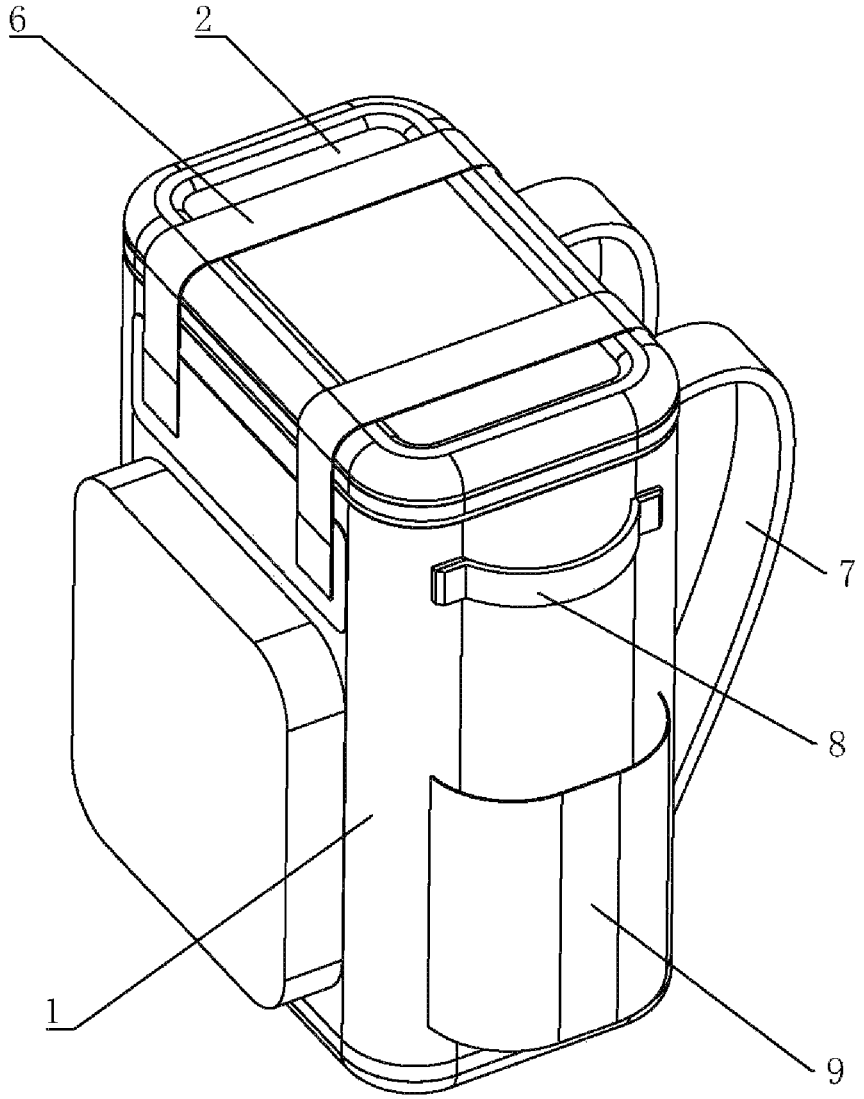
FIG. 6 is a structural schematic diagram of the second embodiment of the present disclosure.
Figure 7:
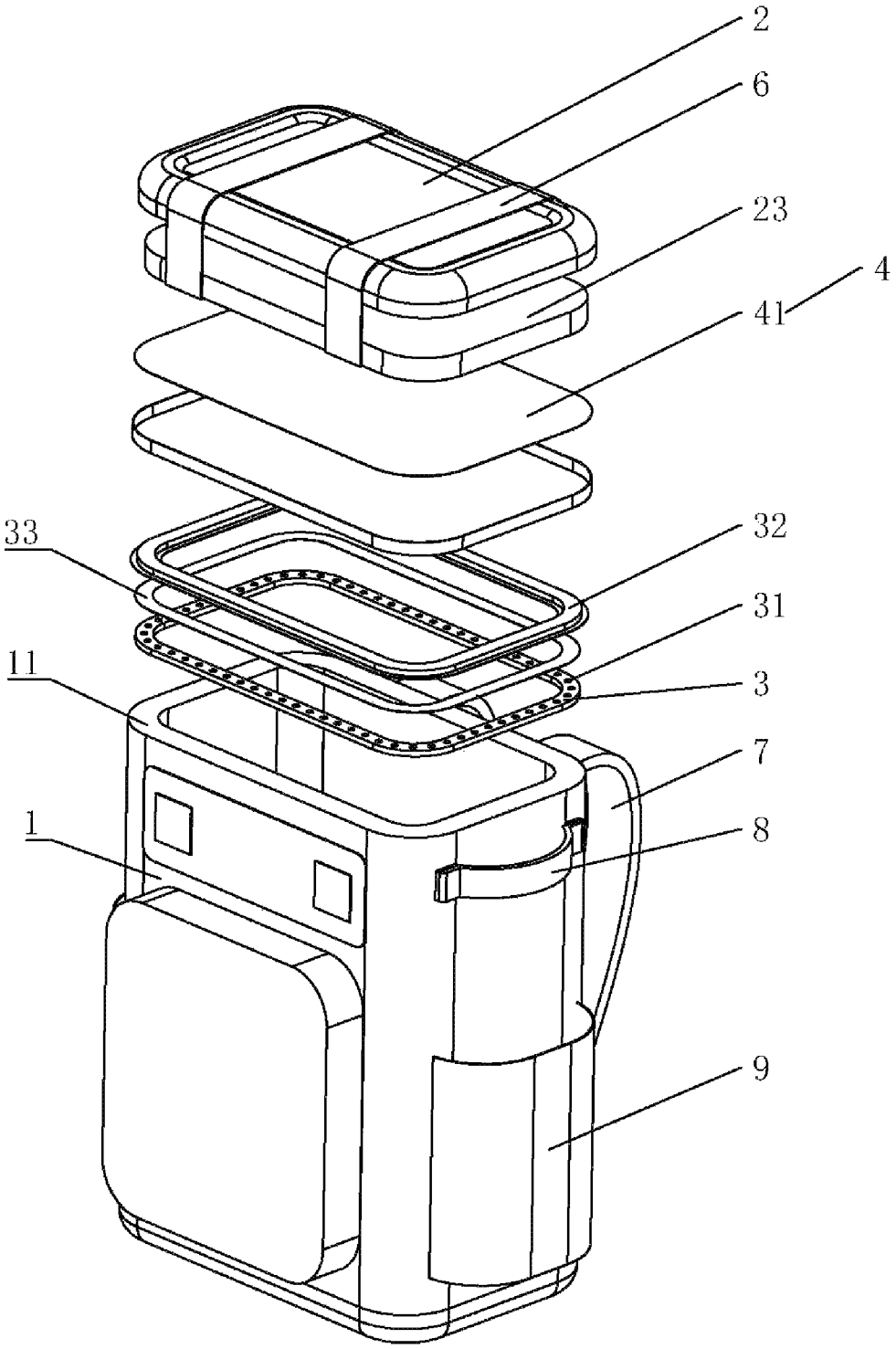
FIG. 7 is an exploded view showing respective components of the second embodiment of the present disclosure.

According to FIG. 6 and FIG. 7, the present embodiment provides another type of insulation bag. The insulation bag includes a main body 1 with a roughly cuboid shape. A top part of the main body 1 is provided with an opening 11, and under the opening 11 formed an insulation chamber. Elastic pockets 9 are arranged at the lower end on two sides of the main body 1 for placing objects. Hand straps 8 are arranged at the top end on two sides of the main body 1 for lifting the insulation bag.

As shown in FIG. 6 and FIG. 7, a lid 2 is arranged at the top of the main body 1, and the lid 2 is rotatably connected to the main body 1 at the rear side, so as to enable the lid 2 to rotate relative to the main body 1 to close or open the opening 11 of the main body 1. As shown in FIG. 7, a first magnetic attractable element is provided at the top of the opening 11 of the main body 1, and a second magnetic attractable element is provided at a bottom surface of the lid 2. When the lid 2 is closed with the main body 1, the first magnetic attractable element is connected with the second magnetic attractable element through magnetic attraction force.

Figure 8:
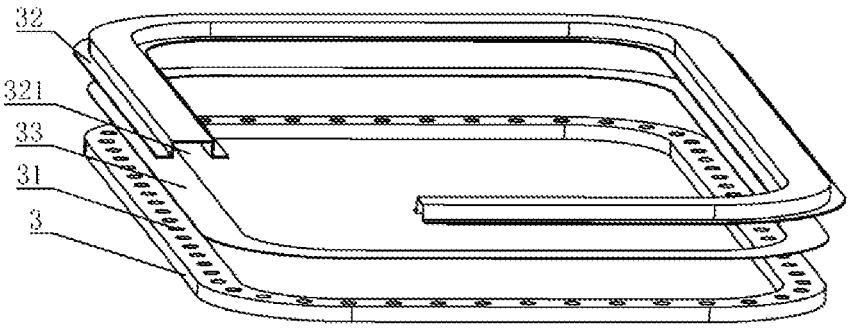
FIG. 8 is a structural diagram of a first magnetic attractable element of the second embodiment of the present disclosure.

As shown in FIG. 7 and FIG. 8, according to the present embodiment, the first magnetic attractable element is arranged on the opening 11 of the main body 1, and the first magnetic attractable element has magnetism. The second magnetic attractable element is a magnetic element 4 arranged at the bottom surface of the lid 2. The magnetic element 4 in this embodiment does not have magnetism itself, but the magnetic element 4 should be made of a ferromagnetic material in order to realize the magnetic attraction with the first magnetic attractable element. The ferromagnetic material substantially includes a pure metal sheet containing iron, nickel or cobalt, or an alloy sheet. The ferromagnetic material may also be a rare earth material containing samarium cobalt magnet or neodymium iron boron magnet. As shown in FIG. 7, the magnetic element 4 in this embodiment is a magnetic plate 41 which is hidden in the bottom surface of the lid 2, and the shape of the magnetic plate 41 matches the shape of the lid 2.

As shown in FIG. 7 and FIG. 8, the first magnetic attractable element includes a magnetic particle positioning element 3 attached to the top surface of the opening 11 of the main body 1. The overall shape of the magnetic particle positioning element 3 matches the shape of the opening 11. The magnetic particle positioning element 3 may have a loop shape and is provided with a plurality of magnetic particle holes 31. The magnetic particle holes 31 are arranged at intervals along the extending tack of the opening 11, and each magnetic particle hole 31 is embedded with a magnet particle. The top surface of the magnetic particle positioning element 3 is provided with a first magnetizable piece 33 sharing the same shape as the magnetic particle positioning element 3.

The first magnetizable piece 33 is wholly made of the above-mentioned ferromagnetic material which forms the foundation for magnetization and magnetic attraction. After the magnet particles are arranged in the magnetic particle positioning element 3, the magnet particles can magnetize the entire first magnetizable piece 33 to produce a magnetism stronger than organized magnets, so that the first magnetizable piece 33 can be connected to the the magnetic element 4 through magnetic attraction. As a result, a better magnetic attraction effect can be achieved while reducing the quantity, weight and production cost of the magnet particles used.

As shown in FIG. 7 and FIG. 8, the top of the first magnetizable piece 33 is provided with a magnet hiding loop 32 covering the first magnetizable piece 33 and the magnetic particle positioning element 3. The bottom surface of the magnet hiding loop 32 is fixed with the opening 11 of the main body 1, and the central part of the magnet hiding loop 32 is raised upward to form a connecting groove 321 of a loop shape. The size of the connecting groove 321 is matched with that of the magnetic particle positioning element 3, and the magnetic particle positioning element 3 and the first magnetizable piece 33 are sequentially embedded and fixed in the connecting groove 321.

The function of the magnet hiding loop 32 is to fix the magnetic particle positioning element 3 and the first magnetizable piece 33 to the opening 11 in a hidden way, so as to keep the opening 11 smooth, tidy, and aesthetic.

Figure 9:
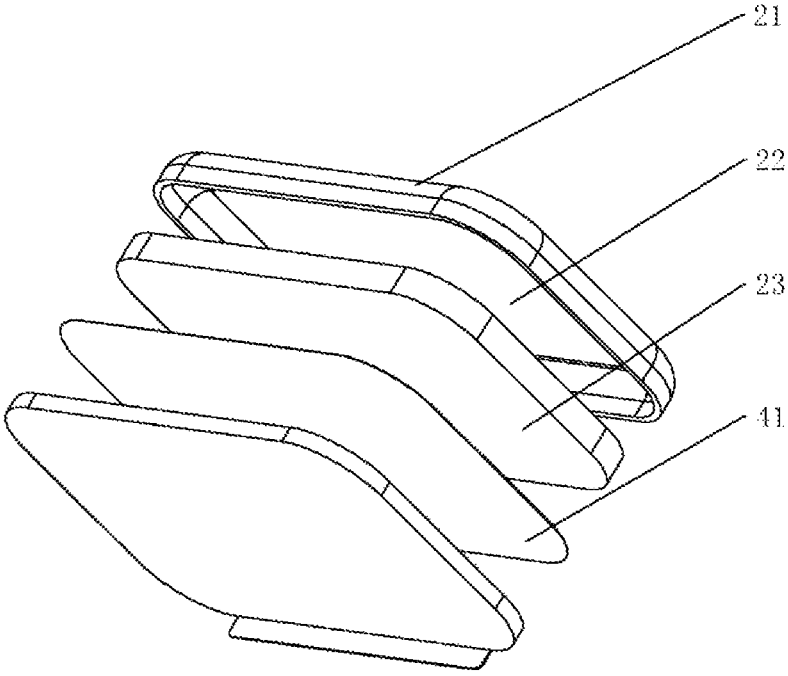
FIG. 9 is a schematic diagram showing the installation position of the magnetic plate of the second embodiment of the present disclosure.

As shown in FIG. 6, FIG. 7 and FIG. 9, the lid 2 further includes a molding frame 21 located at the topmost position and straps 6 wound around the molding frame 21. The right end of the straps 6 are fixed at the rear side of the main body 1, and the left end of the straps 6 goes over the molding frame 21 and is bonded and fixed on the front side of the main body 1. The middle part of the straps 6 are attached to the surface of the molding frame 21. The arrangement of the straps 6 can assist the connection between the first magnetic attractable element and the magnetic element 4.

As shown in FIG. 6, FIG. 7 and FIG. 9, the bottom of the molding frame 21 is provided with a molding recess 22 with concave structure. An insulation pad 23 is arranged in the molding recess 22, and the magnetic plate 41 is fixed on the bottom surface of the insulation pad 23. The insulation pad 23 is relatively thick, and the is made of EVA material. The insulation pad 23 provides buffering and shock absorption during the opening and closing of the lid 2, and owing to its thermal insulation performance and waterproof performance, the insulation pad 23 can improve the insulation effect, sealing and waterproofing effect of the insulation bag.

Specific implementation processes of the present embodiment are described below. According to the present embodiment, the first magnetizable piece 33 attached on the top of the magnetic particle positioning element 3 is magnetized by the plurality of magnet particles, so that the entire first magnetizable piece 33 can have relatively strong magnetism. When the lid 2 covers the opening 11, the first magnetizable piece 33 attracts the magnetic plate 41 at corresponding position. Although the magnetic plate 41 itself is non-magnetic, the magnetic plate 41 is made of ferromagnetic material and can establish magnetic attraction with the first magnetizable piece 33, so as to realize the magnetic connection between the main body 1 and the lid 2. Afterwards, user can pull the strap 6 to go over the lid 2 and stick the end of the strap 6 to the front side of the main body 1 to provide an auxiliary fastening for the lid 2 and the main body 1, thereby improving the firmness of the connection.

Embodiment 3

Figure 10:
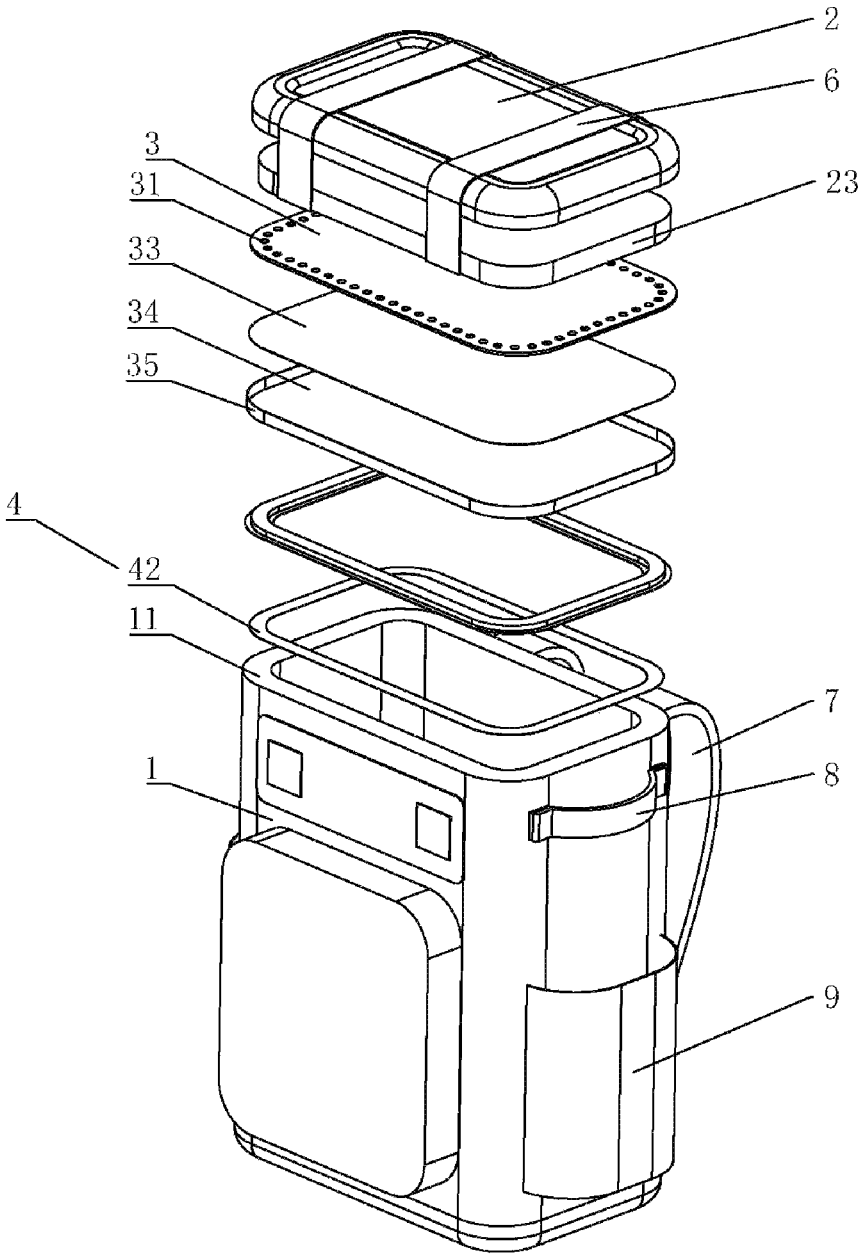
FIG. 10 is an exploded view showing respective components of the third embodiment of the present disclosure.
Figure 11:
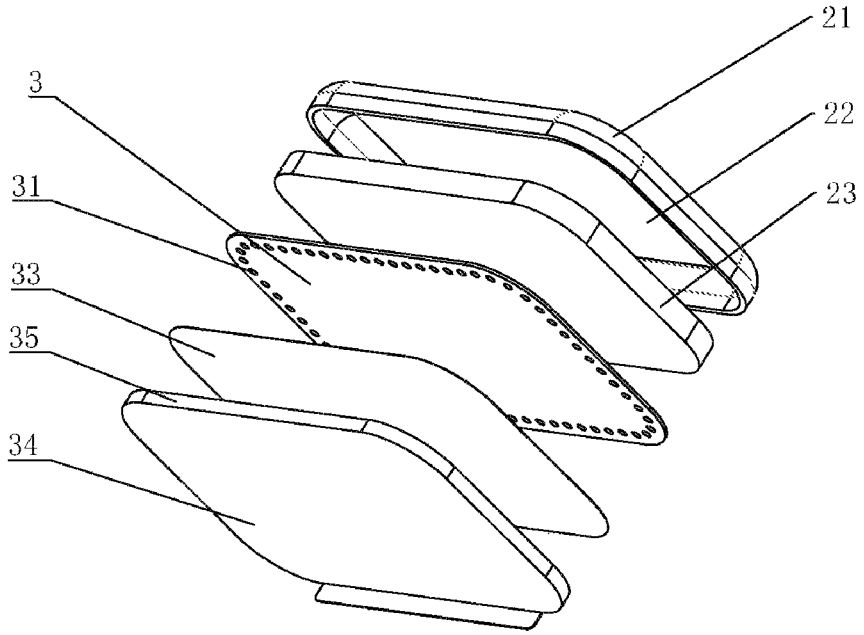
FIG. 11 is a structural diagram of a first magnetic attractable element of the third embodiment of the present disclosure.

Referring to FIG. 10 and FIG. 11, according to the present embodiment, an insulation bag having magnetic closing and sealing structure is different from Embodiment 2 in that the first magnetic attractable element is arranged on the bottom surface of the lid 2. The first magnetic attractable element includes a magnetic particle positioning element 3 arranged at the bottom of the insulation pad 23. The magnetic particle positioning element 3 here has a plate-like structure and its shape matches the insulation pad 23.

Similarly, the plate-shaped magnetic particle positioning element 3 is provided with a plurality of magnetic particle holes 31 distributed along the edge of the magnetic particle positioning element 3, and magnet particles are also embedded in the magnetic particle holes 31. As shown in FIG. 10 and FIG. 11, the bottom surface of the magnetic particle positioning element 3 is attached with a first magnetizable piece 33. According to the present embodiment, the first magnetizable piece 33 shares the same shape with the magnetic particle positioning element 3, i.e. a plate shape, and the first magnetizable piece 33 is made of ferromagnetic material.

As shown in FIG. 10 and FIG. 11, a magnet hiding plate 34 is provided below the first magnetizable piece 33, and the overall shape of the magnet hiding plate 34 is the same as that of the magnetic particle positioning element 3. A loop-shaped connecting part 35 raised upward from the edge of the magnet hiding plate 34 forms a recess with the magnet hiding plate 34. The magnetic particle positioning element 3 and the first magnetizable piece 33 are sequentially placed in the recess, and the top of the connecting part 35 is fixed on the bottom surface of the molding frame 21.

The magnet hiding plate 34 is configured to hide the first magnetic attractable element in the bottom part of the lid 2 to keep the bottom surface of the lid smooth, tidy, and aesthetic.

As shown in FIG. 10 and FIG. 11, the magnetic element 4 in this embodiment is a magnetic loop 42 attached to the top surface of the opening 11 at the top end of the main body 1 and hidden therein. The magnetic loop 42 is made of ferromagnetic material with a shape matching that of the opening 11. The magnetic loop 42 may have a loop shape.

The plurality of magnet particles in the magnetic particle positioning element 3 can magnetize the entire first magnetizable piece 33 to render the first magnetizable piece 33 equipped with a relatively strong magnetism. The first magnetizable piece 33 and the magnetic loop 42 located at the opening 11 work collectively to realize the magnetic coupling of the main body 1 and the lid 2.

Embodiment 4

Figure 12:
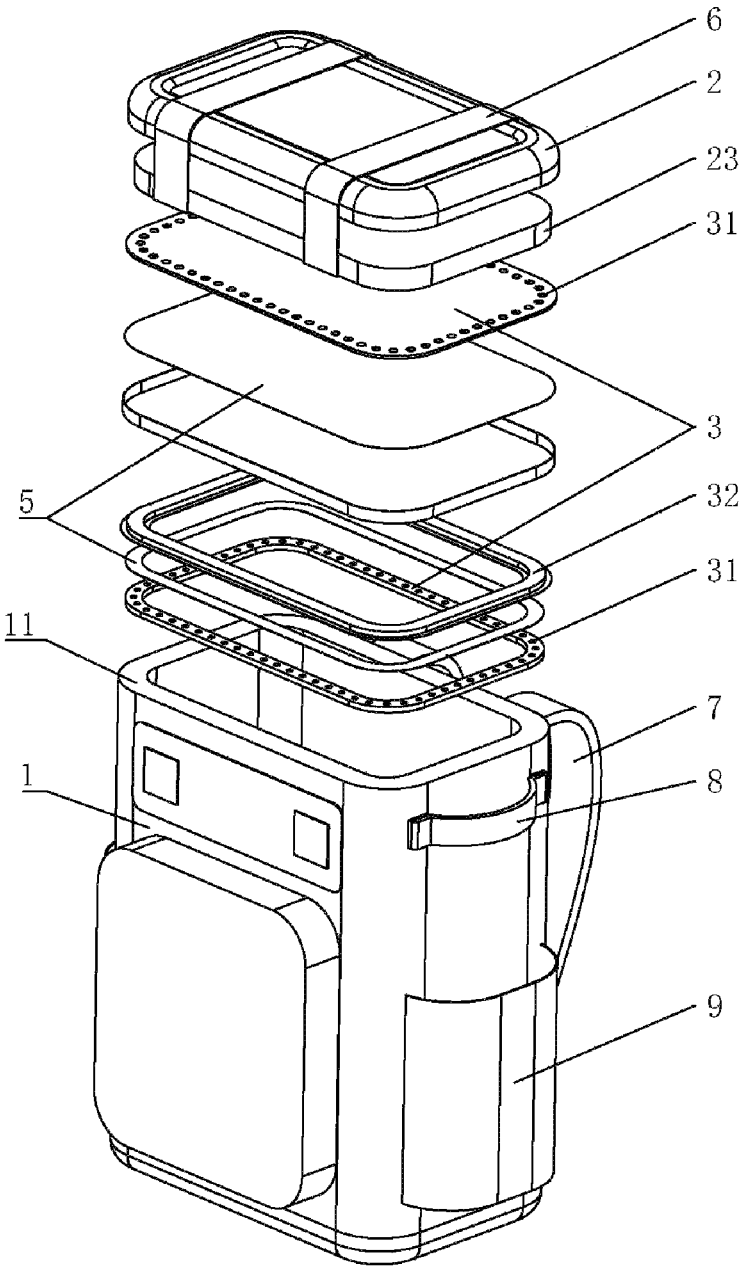
FIG. 12 is an exploded view showing respective components of the fourth embodiment of the present disclosure.
Figure 13:
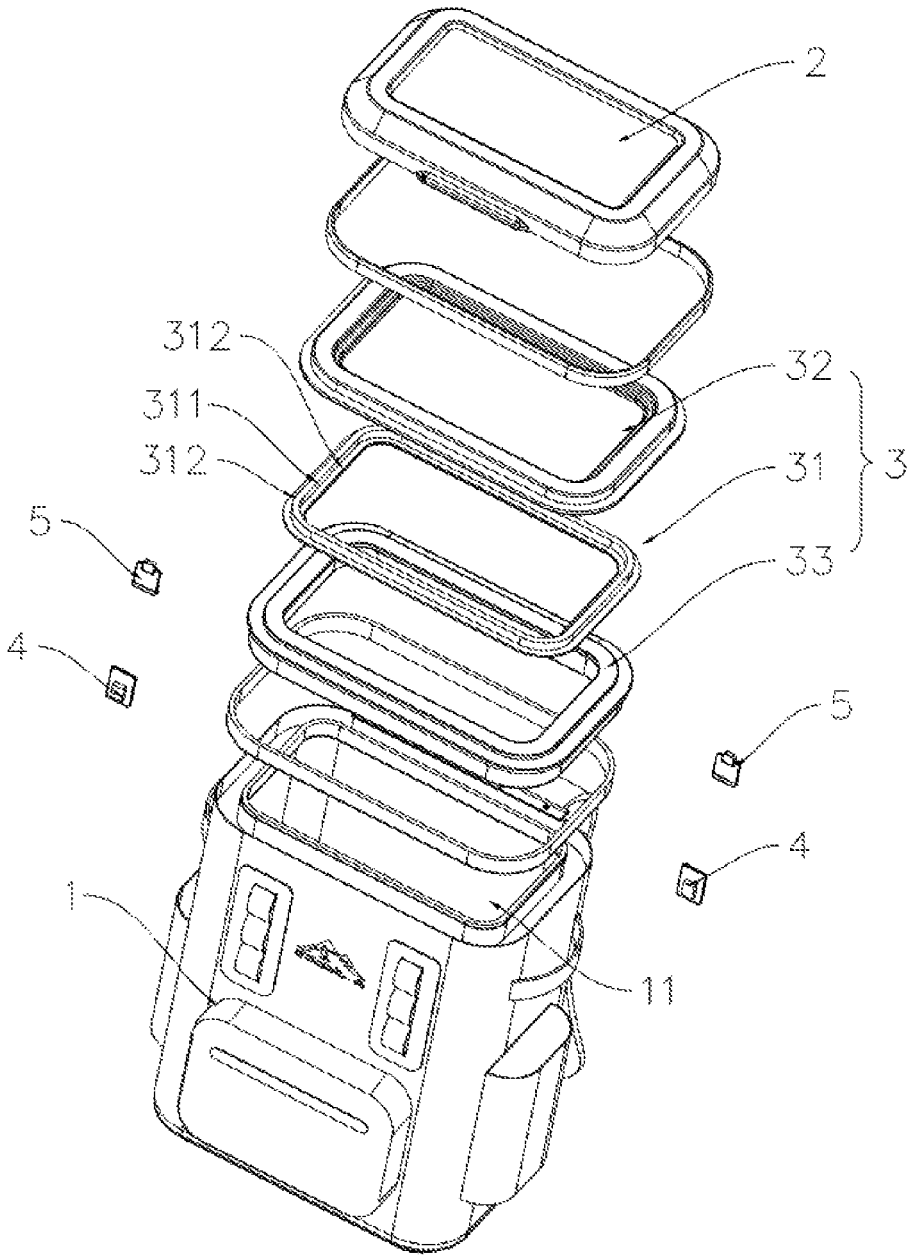
FIG. 13 is an exploded view showing respective components of the fifth embodiment of the present disclosure.
Figure 14:
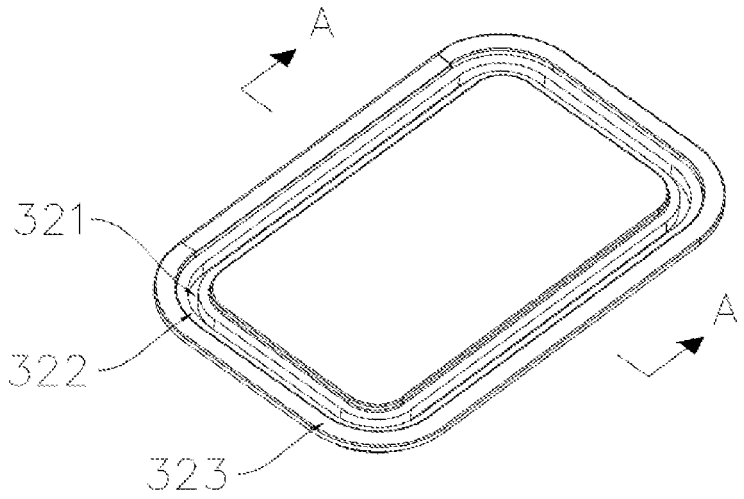
FIG. 14 is a structural schematic diagram of the lower edge loop of the fifth embodiment of the present disclosure.
Figure 15:
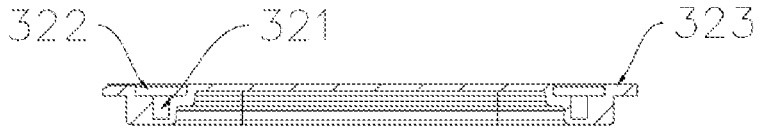
FIG. 15 is a sectional view of the lower edge loop of the fifth embodiment of the present disclosure. (taken on A-A of FIG. 14)
Figure 16:
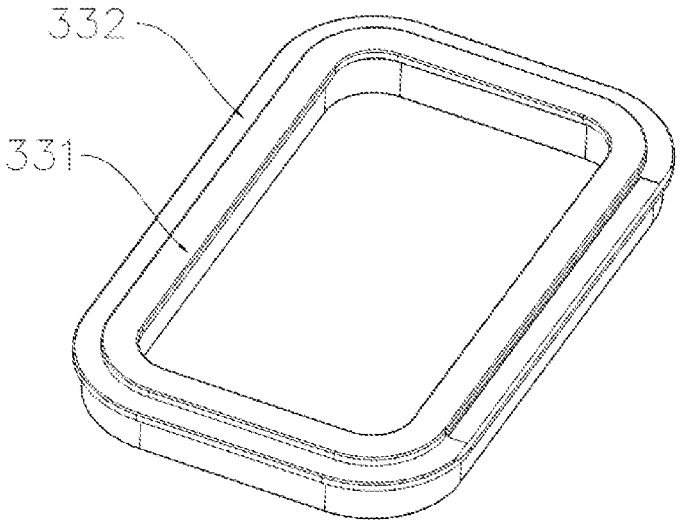
FIG. 16 is a structural schematic diagram of the upper edge loop of the fifth embodiment of the present disclosure.

FIG. 12 shows an insulation bag having magnetic closing and sealing structure, which is different from Embodiment 1 or 2 in that both the first magnetic attractable element and the second magnetic attractable element in this embodiment are magnetic. According to the present embodiment, the first magnetic attractable element is hidden in the opening 11 at the top of the main body 1, and the second magnetic attractable element is hidden in the bottom surface of the lid 2.

As shown in FIG. 12, the structure of the first magnetic attractable element in this embodiment is the same as that of the first magnetic attractable element in embodiment 2. The first magnetic attractable element includes a magnetic particle positioning element 3 of a loop shape, magnetizable piece 5 of a loop shape and magnet hiding loop 32, which are arranged sequentially from bottom to top. The structure of the second magnetic attractable element in this embodiment is the same as the structure of the first magnetic attractable element in embodiment 3. The second magnetic attractable element includes magnetic particle positioning element 3, magnetizable piece 5 of a plate shape, and magnet hiding plate 34, which are arranged sequentially from top to bottom.

In practice, both the first magnetic attractable element and the second magnetic attractable element can have magnetism, so as to attract each other and realize the magnetic connection between the main body 1 and the lid 2.

According to the present embodiment, the main body 1 and the lid 2 are connected through magnetic attraction, and the magnetic attractable elements are hidden in the main body 1 and the lid 2, which improves the appearance of the insulation bag at the position where the lid and the main body connect. One only needs to lift up or cover the lid 2 to open or close the insulation bag, and the lid and main body can establish connection automatically, thus the operation of the insulation bag is convenient and fast. Additionally, the magnetic attractable element can not only improve the firmness of the connection between the main body 1 and the lid 2, but also contribute to the improvement of the insulation effect, thus suppressing the heat exchange with the outside from the joint and improving the insulation effect of the overall insulation bag.

Embodiment 5

Referring to FIGS. 13-18, an insulation bag includes a main body 1, a lid 2 matched with an opening 11, and a sealing assembly 3 for sealing the main body 1 and the lid 2. An upper part of the main body 1 is provided with the opening 11, and the main body 1 is provided with a plurality of lower fasteners 4 at a side of the opening 11. The lid 2 is provided with upper fasteners 5 to be engaged with the lower fasteners 4. When the upper fasteners 5 and the lower fasteners 4 are locked together, the main body 1 and the lid 2 are closed and fixed. The sealing assembly 3 includes a sealing strip 31 arranged along the opening 11 and a lower edge element 32 arranged at a lower side of the lid 2. A bottom side of the lower edge element 32 is provided with a first concave part 321, and a top side of the sealing strip 31 is provided with a first convex part 311 corresponding to the first concave part 321. In practice, the lid 2 is flipped downward to press the first convex part 311 into the first concave part 321, and then the upper fasteners 5 and the lower fasteners 4 are locked together to secure the main body and the lid. The engagement of the upper fasteners 5 and lower fasteners 4 also provides a pressing force to squeeze the first convex part 311 into the first concave part 321, so that the first convex part 311 is deformed and fills in the space of the first concave part 321. In this embodiment, a height of the first convex part 311 is greater than a depth of the first concave part 321, and a width of the first convex part 311 is smaller than a width of the first concave part 321. The sealing strip 31 is made of rubber, TPU, PVC and other materials that have elastic deformation properties. The lower edge element 32 is a rigid part manufactured by injection molding. Since the height of the first convex part 311 is greater than the depth of the first concave part 321, and gaps are reserved between the two sides of the first convex part 311 and the first concave part 321, when the lid is closed, the top of the first convex part 311 is pressed to be closely attached with the first concave part 321, and the sidewall of the first convex part 311 extends outward to be tightly attached with the first concave part 321, so as to seal the joint between the main body 1 and the lid 2. By means of the above solution, the fasteners can provide sufficient pressing force to enable the squeeze and deformation of the sealing components and establish the sealing and fixing structure, which effectively improves the sealing performance while ensuring that the insulation bag is convenient to open and close, i.e. simply by locking or unlocking the fasteners, the bag can be opened or closed. Thus, the utility of the insulation bag is improved.

Specifically, the height of the first convex part 311 is 2 mm-4 mm greater than the depth of the first concave part 321, and the width of the first convex part 311 is 0.5 mm-1.5 mm smaller than the width of the first concave part 321. The gap between the depth of the first convex part 311 and the depth of the first concave part 321 should be greater than the gap between the width of the first convex part 311 and the width of the first concave part 321, so as to ensure that there is sufficient contact area between the sidewalls after the squeeze and deformation to realize the sealing effect. The height of the first convex part 311 is 15 mm-20 mm, and the width is 18 mm-22 mm. With this configuration, there is enough contact area between the sealing components to ensure the sealing effect. Specifically, the height of the first convex part 311 should not be too small, and the sidewalls on both sides of the first convex part 311 having enough height can make sure that the first convex part 311 and the first concave part 321 have sufficient contact surfaces on vertical plane to enhance sealing performance. The width of the first convex part 311 should be larger than the height, so that when the top surface is pressed to make the sidewall extend outwards, the extension amount is sufficient to form contact between the sidewalls.

Further, when the first convex part 311 is inserted into the first concave part 321 in a squeezed manner, the contact area between the sidewall of the first convex part 311 and the sidewall of the first concave part at least accounts two thirds of the sidewall area of the first concave part 321. If the contact area of the sidewalls after squeeze and deformation is less than two thirds of the sidewall area of the first concave part 321, the sealing performance of the sealing assembly may not be ideal and may result in leakage of liquid or air.

According to the present embodiment, the height of the first convex part 311 is 3 mm greater than the depth of the first concave part 321, and the width of the first convex part 311 is 1 mm smaller than the width of the first concave part 321. The first convex part 311 has a width of 20 mm and a height of 15 mm. Under such condition, when the lid 2 and the main body 1 are closed and fixed, the contact area between the sidewall of the first convex part 311 and the sidewall of the first concave part 321 is seven eights of the sidewall area of the first concave part 321, and gaps only exist at the corners, thereby achieving large contact area and ensuring sealing property of the insulation bag.

Preferably, a cavity is formed inside the first convex part 311, so that the outer wall of the first convex part 311 is a thin wall which has better extensibility to fill the concave space when squeezed. The thickness of the two side parts and the top wall out of the first convex part 311 is not less than 2 mm to ensure sufficient structural strength to realize the sealing. Preferably, the top part and the side parts of the first convex part 311 are connected by an arc-shaped surface which forms a trend for guiding the side parts to extend outward during the outward expansion, so as to prevent the side part from retracting inward under pressure. Further, the first convex part 311 may have an oval-like shape with a relatively narrow top part and two sidewalls gradually extends outward from the joint with the top part. With this structure, there is a trend that the convex part 311 extends outward from two sides when deformed under pressure.

According to the present embodiment, the sealing assembly 3 further includes an upper edge element 33 arranged on the opening 11, and a second convex part 331 is provided and extends around the top of the upper edge element 33. A first step 332 lower than the second convex part 331 is provided at the outer side of the second convex part 331, and the sealing strip 31 is mounted on the second convex part 331. A second concave part 322 corresponding to the second convex part 331 is arranged at the bottom of the lower edge element 32. A second step 323 is provided at an outer side of the second concave part 322 at a position corresponding to the first step 332. The first concave part 321 is located inside the second concave part 322. When the lid is closed and to be fastened, the first step 332 is closely attached to the second step 323. Further, the sealing strip 31 also includes shoulders 312 integrally provided on both sides of the first convex part 311, and the sidewalls of the shoulders 312 are aligned with the sidewalls of the second convex part 331. The sidewalls of the shoulders 312 and the second convex part 331 fit with the second concave part 322, and the top wall of the shoulders 312 fits with the bottom surface of the second concave part 322. The depth of the second concave part 322 is equal to or less than the sum of the heights of the shoulders 312 and the second convex part 331, so that the shoulders 312 and the second convex part 331 can be inserted into the second concave part 322 to close the lid. Among them, the upper edge element 33 is integrally formed by injection molding and is a rigid part. The second convex part 331 and the second concave part 322 are fitted with each other and play a role of positioning to make the sealing structure of the opening more stable and less likely to get deformed, thereby avoiding displacement or detachment of the sealing components due to the impact of external force.

Preferably, the depth of the second concave part 322 is 0.2 mm-0.5 mm smaller than the sum of the heights of the shoulders 312 and the second convex part 331, so as to improve the sealability at the second concave part 322.

Figure 17:
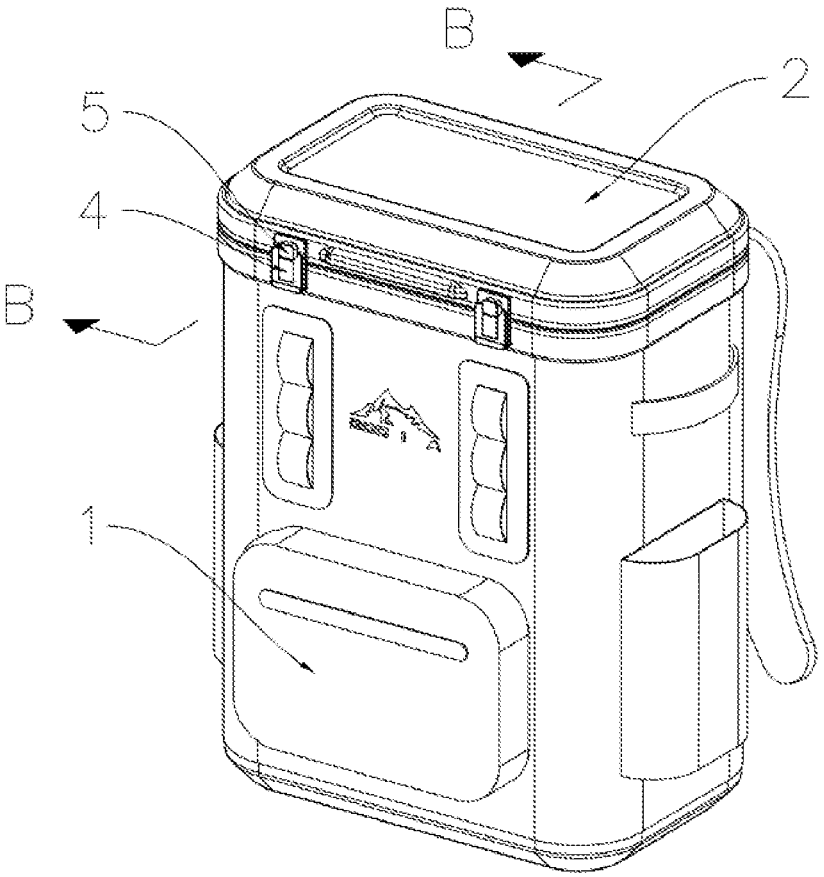
FIG. 17 is a diagram showing the closed state of the fifth embodiment of the present disclosure.
Figure 18:
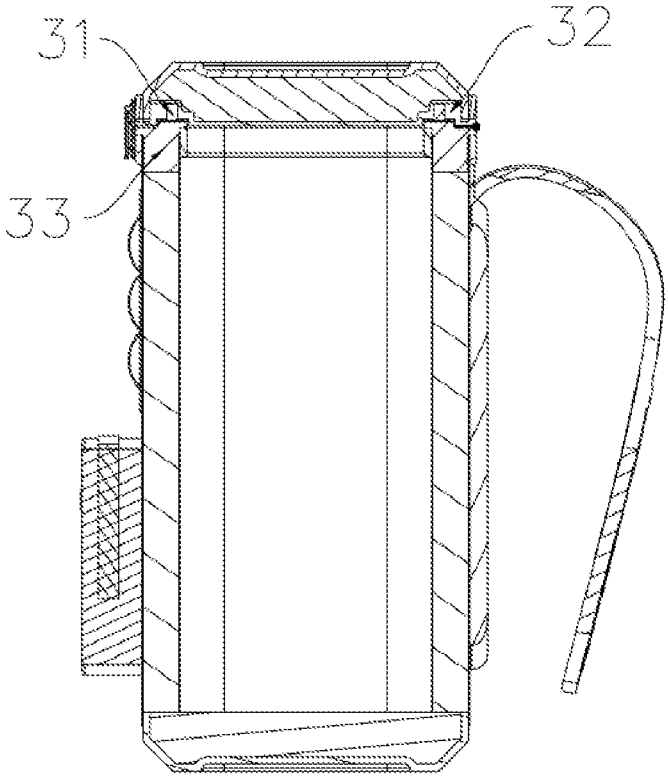
FIG. 18 is a sectional view of the closed state of the fifth embodiment of the present disclosure. (taken on B-B of FIG. 17)

In addition, there are at least two lower fasteners 4 symmetrically arranged on the front wall or/and both two sidewalls of the main body 1. With reference to FIG. 17, in this embodiment, two sets of lower fasteners 4 and upper fasteners 5 are arranged symmetrically on the front wall of the insulation bag, so that the two sides of the lid and opening are evenly stressed to ensure the stability of the sealing structure.

In this embodiment, the main body and the lid of the insulation bag are both provided with cotton layer(s) to improve insulation effect. The parts where the main body and the lid connect are provided with edge covering to improve structural stability and strength.

Embodiment 6

On the basis of Embodiment 5, a first magnetic attractable element (not shown in the drawing) is embedded in the first convex part of the sealing strip 31, and a second magnetic attractable element (not shown in the drawing) corresponding to the first magnetic attractable is arranged inside the first concave part 321. When the first convex part is inserted into the first concave part 321, the first magnetic attractable element and the second magnetic attractable element are attached together under magnetic attraction force, so as to realize the securing of the main body and the lid of the insulation. Among them, the magnetic attractable element may be several uniformly distributed magnet particles, or may be a piece or pieces of magnet sheet(s).

The above description merely includes preferred implementations of the present disclosure which are not intended to limit the present disclosure. For those skilled in the art, the present disclosure may have various modifications and changes. Any modification, equivalent substitution, improvement, and so on made within the spirit and principle of the present disclosure should be considered as falling within the scope of protection of the present disclosure.

What is claimed is:

1. An insulation bag, comprising:

a main body, wherein the main body has an opening at an upper end and the opening is provided with an upper edge loop, the upper edge loop includes a convex part extending along the upper edge loop, a plurality of first magnetic attractable elements are evenly arranged on the convex part; and a lid, wherein the lid is configured to seal the opening at the upper end of the main body, a lower edge loop is fixed at a bottom of the lid, the lower edge loop includes a concave part corresponding to the convex part, the concave part is internally provided with a plurality of second magnetic attractable elements corresponding to the first magnetic attractable elements, when the lid is covering the upper end of the main body, the concave part is fully engaged with the convex part, and the first magnetic attractable elements and the second magnetic attractable elements attach to each other through magnetic attraction, two sides of the convex part are respectively provided with a first shoulder part and two sides of the concave part are respectively provided with a second shoulder part to establish a concave-convex fit with full surface contact at a joint therebetween and two closed vertical surfaces are formed at an inner side and an outer side of the joint between the lid and the upper end of the main body.

2. The insulation bag according to claim 1, wherein a side of the lid is rotatably connected to a back side of the main body, the lid is provided with a fastener, a front side of the main body is provided with a engagement groove matching with the fastener, when the lid is closed with the main body to seal the insulation bag, the fastener is engaged with the engagement groove.

3. The insulation bag according to claim 1, wherein the upper edge loop further comprises first shoulder parts located at two sides of the convex part, and the lower edge loop further comprises second shoulder parts located at two sides of the concave part.

4. The insulation bag according to claim 1, wherein the first magnetic attractable elements are embedded in the convex part, and the second magnetic attractable elements are embedded in the concave part.

5. The insulation bag according to claim 1, wherein the main body is provided with an adjustable shoulder strap and a hand strap.

6. The insulation bag according to claim 1, wherein the lower edge loop is fixed on the bottom of the lid by laser welding.

7. An insulation bag, comprising:

a main body, wherein the main body is provided with an opening;

a lid, wherein the lid is configured to close the opening; and a magnetic attractable assembly for attaching the lid on the opening, wherein the magnetic attractable assembly includes a first magnetic attractable element arranged in the opening and being invisible from the outside or the lid and a second magnetic attractable element corresponding to the first magnetic attractable element arranged on the lid or the opening;

wherein the first magnetic attractable element includes a magnetic particle positioning element, a plurality of magnetic particle holes provided on the magnetic particle positioning element and arranged at intervals along the opening, and magnet particles arranged in the magnetic particle holes; the second magnetic attractable element includes a magnetic element configured to closely attract the lid to the opening under the attraction of the magnet particles, or the second magnetic attractable element also includes a magnetic particle positioning element, a plurality of magnetic particle holes provided on the magnetic particle positioning element and arranged at intervals along the opening, and magnet particles arranged in the magnetic particle holes;

wherein the first magnetic attractable element comprises a magnet hiding loop fitted with and fixed on the opening to cover and hide the magnetic particle positioning element, a central part of the magnet hiding loop protrudes upward to form a connecting groove of a loop shape, and the magnetic particle positioning element has the same shape as the connecting groove and is embedded and fixed in the connecting groove.

8. The insulation bag according to claim 7, wherein the first magnetic attractable element comprises a first magnetizable piece, the first magnetizable piece has the same shape as the magnetic particle positioning element and is attached on a top surface of the magnetic particle positioning element, the magnetizable piece is embedded between the magnetic particle positioning element and an inner top surface of the connecting groove.

9. The insulation bag according to claim 8, wherein the magnetic element is a magnetic plate connected to the lid and the magnetic plate is invisible from the outside, the magnetic plate and the first magnetic attractable element attract each other by magnetic force, and the first magnetizable piece and the magnetic plate are both made of ferromagnetic material.

10. The insulation bag according to claim 7, wherein the first magnetic attractable element comprises a magnet hiding plate fitted with and attached on a bottom surface of the lid, the magnet hiding plate is configured to cover and hide the magnetic particle positioning element in the bottom surface of the lid, a connecting part is raised upward from an edge of the magnet hiding plate to form a recess, the magnetic particle positioning element has a shape fitted with a shape of the lid, and the magnetic particle positioning element is arranged in the recess formed by the connecting part and the magnet hiding plate.

11. The insulation bag according to claim 10, wherein the first magnetic attractable element comprises a first magnetizable piece, the first magnetizable piece has a shape the same as the magnetic particle positioning element and is attached with a bottom surface of the magnetic particle positioning element, the first magnetizable piece is embedded in the recess and located between the magnetic particle positioning element and the magnet hiding plate.

12. The insulation bag according to claim 11, wherein the magnetic element is a magnetic loop attached to a top surface of the opening and the magnetic loop is invisible from the outside, the magnetic loop and the first magnetic attractable element attract each other by magnetic force, and the first magnetizable piece and the magnetic loop are both made of ferromagnetic material.

13. The insulation bag according to claim 12, wherein a strap is fixed on the main body, a first end of the strap is fixed on a side of the main body, a second end of the strap goes over the lid to be attached on another side of the main body to provide an auxiliary fastening for the lid.

14. The insulation bag according to claim 7, wherein the second magnetic attractable element includes the magnetic particle positioning element, the plurality of magnetic particle holes provided on the magnetic particle positioning element and the magnet particles arranged in the magnetic particle holes, the first magnetic attractable element and the second magnetic attractable element are both provided with a magnetizable piece having a shape fitted with a shape of the magnetic particle positioning element, and the magnetizable piece is made of ferromagnetic material.

15. An insulation bag, comprising:

a main body, wherein an upper part of the main body is provided with an opening, and the main body is provided with a plurality of lower fasteners at a side of the opening;

a lid matched with the opening, wherein the lid is provided with upper fasteners configured to be engaged with the lower fasteners; and a sealing assembly, wherein the sealing assembly includes a sealing strip arranged along the opening and a lower edge element arranged at a lower side of the lid, a bottom side of the lower edge element is provided with a first concave part, and a top side of the sealing strip is provided with a first convex part connectable to the first concave part in a squeezed manner, wherein the first convex part has a height greater than a depth of the first concave part, and the first convex part has a width smaller than a width of the first concave part;

wherein the sealing assembly further comprises an upper edge element arranged on the opening, and a second convex part is provided and extends around the top of the upper edge element, the sealing strip is mounted on the second convex part, a second concave part corresponding to the second convex part is arranged at the bottom of the lower edge element, the first concave part is located inside the second concave part, when the second convex part is inserted into the second concave part, the first convex part is squeezed in the first concave part.

16. The insulation bag according to claim 15, wherein the height of the first convex part is 2 mm-4 mm greater than the depth of the first concave part, and the width of the first convex part is 0.5 mm-1.5 mm smaller than the width of the first concave part.

17. The insulation bag according to claim 15, wherein the sealing strip further comprises shoulders integrally provided on both sides of the first convex part, and sidewalls of the shoulders are aligned with sidewalls of the second convex part, a depth of the second concave part is equal to a sum of the heights of the shoulders and the second convex part.

18. The insulation bag according to claim 15, wherein a cavity is formed inside the first convex part, a top part and side parts of the first convex part are connected by an arc-shaped surface.

* * * * *